US007409925B2

(12) United States Patent
Lannes et al.

(10) Patent No.: US 7,409,925 B2
(45) Date of Patent: Aug. 12, 2008

(54) WATER HEATER FOAM DAM AND COMPONENT COVER AND METHOD FOR COVERING A COMPONENT OF A WATER HEATER

(75) Inventors: Eric M. Lannes, Caledonia, MI (US); Ryan C. Ritsema, Middleville, MI (US)

(73) Assignee: Bradford White Corporation, Ambler, PA (US)

( * ) Notice: Subject to any disclaimer, the term of this patent is extended or adjusted under 35 U.S.C. 154(b) by 50 days.

(21) Appl. No.: 11/484,452

(22) Filed: Jul. 11, 2006

(65) Prior Publication Data

US 2008/0011246 A1 Jan. 17, 2008

(51) Int. Cl.
*F24H 9/02* (2006.01)

(52) U.S. Cl. ..... 122/19.2; 392/449

(58) Field of Classification Search ..... 122/19.2, 122/494; 392/449; 220/567.3, 694.1; 126/344.1
See application file for complete search history.

(56) References Cited

U.S. PATENT DOCUMENTS 4,372,028 A 2/1983 Clark et al.
4,447,377 A 5/1984 Denton
4,744,488 A 5/1988 Nelson
4,861,968 A 8/1989 West
5,052,346 A 10/1991 Beck
5,163,119 A 11/1992 Windon
5,251,282 A 10/1993 Hanning et al.
5,293,844 A 3/1994 Threatt
5,299,280 A 3/1994 Ruark
5,474,202 A 12/1995 Moore, Jr.
5,711,256 A 1/1998 Brandon
6,658,204 B2 * 12/2003 Schurter et al. ..... 392/441
6,898,375 B2 * 5/2005 Henderson et al. ..... 392/478

* cited by examiner

*Primary Examiner*—Gregory A Wilson
(74) *Attorney, Agent, or Firm*—RatnerPrestia

(57) ABSTRACT

A foam dam is provided for use with a water heater having a tank and a jacket together defining an annular region. The foam dam includes a central region having a surface configured to cover a component coupled to the tank. The foam dam also includes a perimeter region extending from the central region. The perimeter region of the foam dam defines a surface to at least substantially traverse the annular region between the tank and jacket of the water heater. The perimeter region is configured to substantially prevent foam insulation from flowing into an area proximate to the component.

23 Claims, 4 Drawing Sheets

WATER HEATER FOAM DAM AND COMPONENT COVER AND METHOD FOR COVERING A COMPONENT OF A WATER HEATER

BACKGROUND OF THE INVENTION

This invention relates to water heaters having foam insulation injected in an annular region between the water heater tank and the water heater jacket. In particular, the invention relates to substantially preventing the foam insulation from flowing into an area proximate to one or more electrical components coupled to the water heater.

It has been found to be commercially advantageous to fill the annular region with flowable foam forming material to provide highly efficient insulation between the water heater tank and the water heater jacket. A problem has arisen, especially in making water heaters provided with electrical or other control components coupled to the water heater tank and positioned in the annular region, when the foam forming material flows into contact with certain water heater components. The flowable foam insulation injected into the annular region is therefore advantageously prevented from flowing into an area proximate to such components, including electrical and other control components. Otherwise, the flowable foam insulation may interfere with effective operation of the components or control devices of the water heater.

A continuing need therefore exists for a water heater foam dam and component cover and a method for covering a component of a water heater.

SUMMARY OF THE INVENTION

The present invention provides a water heater comprising a tank, a jacket surrounding the tank and foam insulation in an annular region between the tank and jacket. The water heater also comprises a component coupled to the tank and a foam dam. The foam dam includes a central region having a surface covering the component and a perimeter region. The perimeter region extends from the central region and defines a surface at least substantially traversing the annular region, wherein the perimeter region forms a barrier between the foam insulation and an area proximate to the component.

The present invention further provides a foam dam for use with a water heater having a tank and a jacket together defining an annular region. The foam dam comprises a central region having a surface configured to cover a component coupled to the tank. The foam dam also comprises a perimeter region extending from the central region. The perimeter region defines a surface to at least substantially traverse the annular region, wherein the perimeter region is configured to substantially prevent foam insulation from flowing into an area proximate to the component.

The present invention further provides a foam dam for use with a water heater having a tank and a jacket together defining an annular region. The foam dam comprises a central region and a perimeter region extending from the central region. The perimeter region includes a first surface occupying a first plane, a second surface occupying a second plane spaced from the first plane and a third surface extending from the first surface to the second surface, wherein the third surface substantially prevents foam insulation from flowing into an area proximate to a component.

The present invention further provides a foam dam for use with a water heater having a tank and a jacket together defining an annular region. The foam dam comprises means for covering a component on the tank of the water heater and means, integral with the component covering means, for substantially preventing foam insulation from flowing from the annular region into an area proximate to the component.

The present invention further provides a method for covering a component of a water heater and for substantially preventing foam insulation from flowing into an area proximate to the component. The method comprises positioning a foam dam in an annular region between a water heater tank and a water heater jacket. The method further comprises covering the component with a central region of the foam dam, injecting foam insulation into the annular region, and substantially preventing the foam insulation from flowing into an area proximate to the component with a perimeter region of the foam dam extending from the central region.

BRIEF DESCRIPTION OF THE DRAWINGS

The invention is best understood from the following detailed description when read in connection with the accompanying drawings. Included in the drawings are the following figures.

DETAILED DESCRIPTION OF THE INVENTION

Figure 1C:
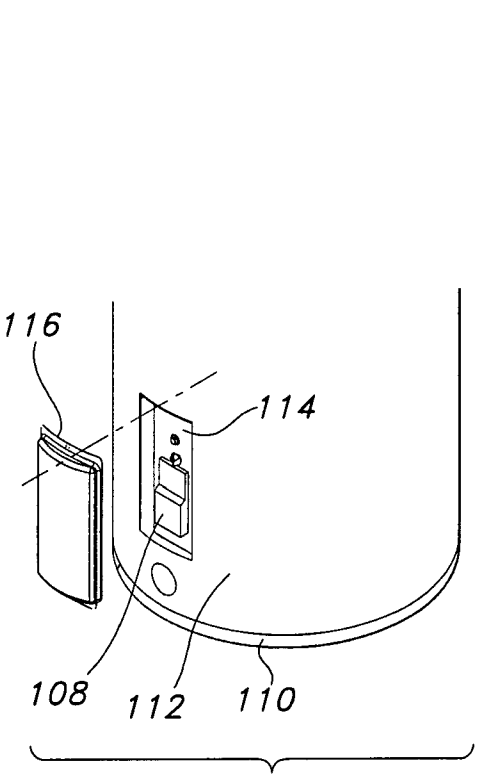
FIGS. 1A through 1C are exploded perspective views of an exemplary water heater according to one embodiment of the invention.

Although the invention is illustrated and described herein with reference to specific embodiments, the invention is not intended to be limited to the details shown. Rather, various modifications may be made in the details within the scope and range of equivalents of the claims and without departing from the invention.

The invention is best understood from the following detailed description when read in connection with the accompanying drawing figures, which shows exemplary embodiments of the invention selected for illustrative purposes. The invention will be illustrated with reference to the figures. Such figures are intended to be illustrative rather than limiting and are included herewith to facilitate the explanation of the present invention.

Referring generally to the figures, one embodiment of this invention provides a water heater including a tank 100, a jacket 112 surrounding the tank 100 and foam insulation 322 in an annular region between the tank 100 and the jacket 112. The water heater also includes a component coupled to the tank 100 and a foam dam 108, 200, 300. The foam dam 108, 200, 300 includes a central region 202 having a surface covering the component and a perimeter region 204. The perimeter region 204 extends from the central region 202 and defines a surface at least substantially traversing the annular region, wherein the perimeter region 204 forms a barrier between the foam insulation 322 and an area proximate to the component.

The perimeter region 204 of the foam dam 108, 200, 300 optionally includes a first surface 214 occupying a first plane, a second surface 216 occupying a second plane spaced from the first plane and a third surface 218 extending from the first surface 214 to the second surface 216. The third surface 218 substantially prevents foam insulation 322 from flowing into an area proximate to a component of the water heater.

According to another aspect, the present invention further provides a method for covering a component of a water heater and for substantially preventing foam insulation 322 from flowing into an area proximate to the component. The method comprises positioning a foam dam 108, 200, 300 in an annular region between a water heater tank 100 and a water heater jacket 112 and covering the component with a central region 202 of the foam dam 108, 200, 300. The method further comprises injecting foam insulation 322 into the annular region and substantially preventing the foam insulation 322 from flowing into an area proximate to the component with a perimeter region 204 of the foam dam 108, 200, 300 extending from the central region 202.

Figure 1B:
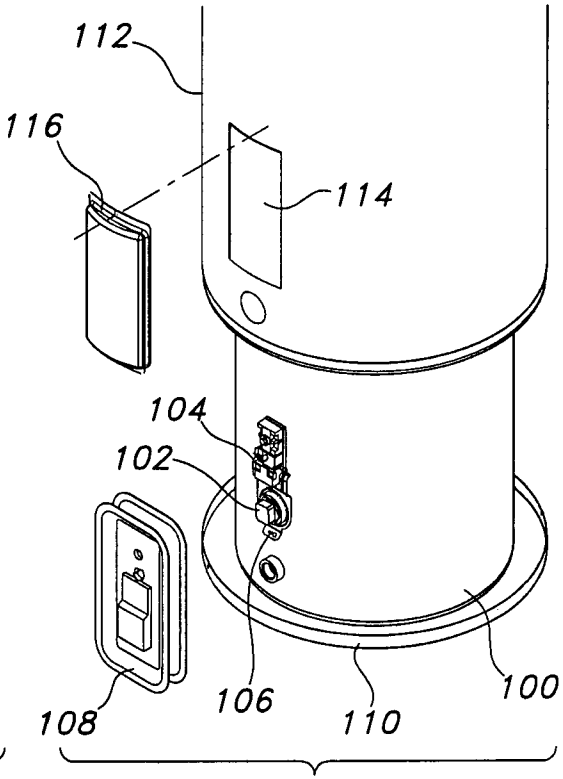
Figure 1A:
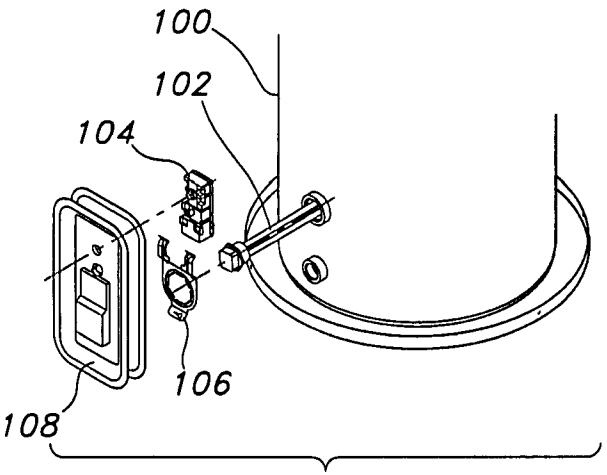

The assembly of an exemplary water heater according to one embodiment of the invention is illustrated in FIG. 1A through FIG. 1C. FIG. 1A shows an exploded perspective view of an exemplary pre-assembled water heater, including a tank, a foam dam, a thermostat, and a thermostat bracket according to one embodiment of the invention. As shown in FIG. 1A, a heating element 102 extends within water heater tank 100. FIG. 1A also shows a thermostat 104, a thermostat bracket 106 and a foam dam 108 to be assembled.

A thermostat may include one or more electrical components for operating the water heater. It may be desirable to limit user access to the electrical components, the heating element or other components which may cause harm to the user if the user contacts any of these components.

FIG. 1B shows the next step of assembling the exemplary water heater according to one embodiment of the invention. As shown in FIG. 1B, heating element 102, thermostat 104 and thermostat bracket 106 are assembled together and coupled to water heater tank 100. Water heater tank 100 is coupled to water heater jacket base 110. FIG. 1B also shows a water heater jacket 112, which includes a jacket aperture 114, and is shown surrounding a portion of water heater tank 100. FIG. 1B also shows foam dam 108 and a control access cover 116 to be assembled. The precise location of heating element 102, thermostat 104, thermostat bracket 106 and jacket aperture 114 shown in FIG. 1B is merely illustrative and is not limiting.

FIG. 1C shows the next step of assembling the exemplary water heater according to one embodiment of the invention. As shown in FIG. 1C, water heater jacket 112 surrounds water heater tank 100 (not shown) and sits on top of jacket base 110. Foam dam 108 is seen through jacket aperture 114 positioned between water heater tank 100 (not shown) and water heater jacket 112. FIG. 1C also shows control access cover 116 to be coupled to water heater jacket 112 for covering jacket aperture 114.

FIG. 2A through FIG. 2E show different views of an exemplary foam dam according to one embodiment of the invention. It is contemplated that exemplary foam dams may be used with electric, gas or oil water heaters. For purposes of illustration only, foam dams are shown and described herein primarily in connection with electric water heaters.

Figure 2B:
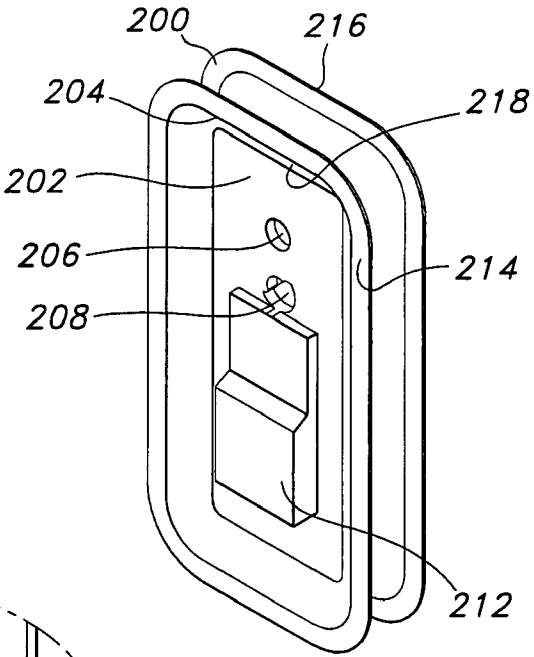
FIG. 2B is a perspective view of the foam dam shown in FIG. 2A.
Figure 2C:
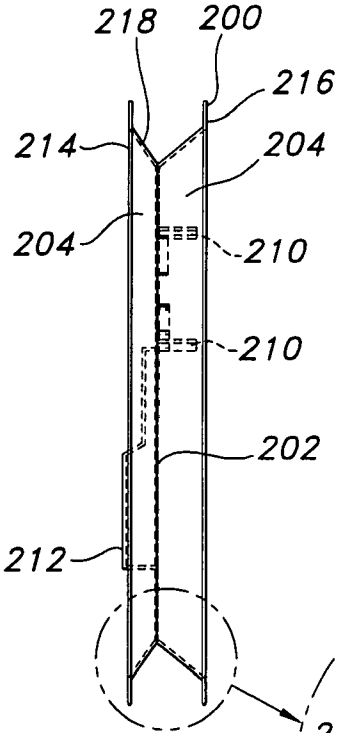
FIG. 2C is a side view of the foam dam shown in FIG. 2A.
Figure 2F:
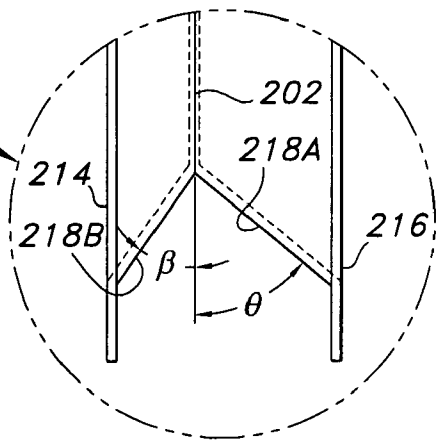
FIG. 2F is a side view of a portion of the foam dam shown in FIG. 2A.
Figure 2A:
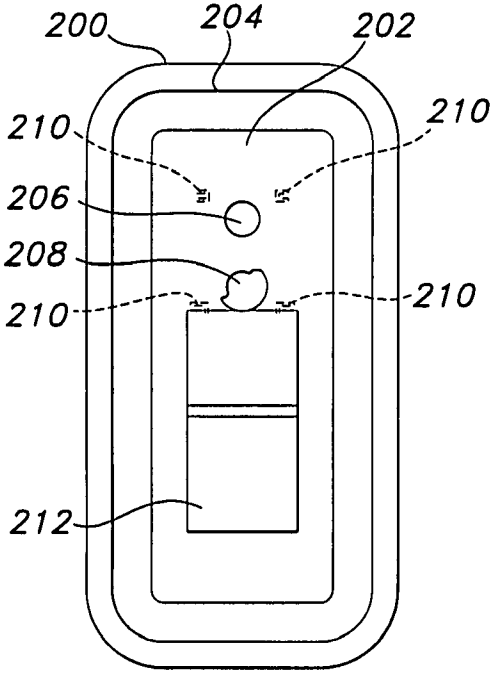
FIG. 2A is a front view of an exemplary foam dam according to one embodiment of the invention.

FIG. 2A is a front view of an exemplary foam dam, generally designated by the numeral "200", according to one embodiment of the invention. As shown in FIG. 2A, foam dam 200 includes a central region 202 and a perimeter region 204 extending from central region 202. Perimeter region 204 extends about the entire perimeter of central region 202 in the illustrated embodiment. Generally, and as will be discussed later in greater detail, central region 202 is configured to cover a component of a water heater and perimeter region 204 is configured to at least partially block insulating foam from contacting the water heater component.

Central region 202 includes a manual reset aperture 206 and a temperature adjuster aperture 208. It is contemplated that the central region of an exemplary foam dam may include apertures for other water heater components which may require human interaction. It is also contemplated that the central region of an exemplary foam dam may not include any apertures.

FIG. 2A shows locating guides 210 coupled to central region 202 to assist coupling the foam dam to the water heater. It is contemplated that at least one locating guide may be used to position or couple the foam dam to a thermostat or another component which may be coupled to the water heater. It is also contemplated that locating guides may not be used for coupling the foam dam to the water heater. The optional locating guides 210 are also shown in FIGS. 2B through 2E, and such guides may be provided in any quantity or configuration desired for coupling or support of the foam dam with respect to other components or surfaces of a water heater.

Central region 202 of foam dam 200 also includes an optional heating element cover 212. It may be desirable for a heating element cover to be integral to the foam dam to reduce costs during the manufacturing process. It is also contemplated however, that a heating element cover may be coupled to the foam dam during the manufacturing process or that a heating element cover may not be used. The precise locations of a manual reset aperture 206, a temperature adjuster aperture 208, locating guides 210 and heating element cover 212 are merely illustrative and are not limiting.

FIG. 2B shows central region 202. FIG. 2B also shows details of perimeter region 204 extending from central region 202. As described above, central region 202 includes manual reset aperture 206, temperature adjuster aperture 208, heating element cover 212 and locating guides 210 coupled to central region 202 to assist coupling the foam dam to the water heater. Perimeter region 204 includes a first surface 214, a second surface 216 and a third surface 218. These surfaces are described in more detail below with reference to FIG. 2C.

FIG. 2C is a side view of foam dam 200, according to one embodiment of the invention. As described above, central region 202 of foam dam 200 includes heating element cover 212 and locating guides 210 coupled to central region 202 to assist coupling the foam dam to the water heater. Perimeter region 204 includes first surface 214 occupying a first plane, second surface 216 occupying a second plane spaced from the first plane and third surface 218 extending from first surface 214 to second surface 216. Perimeter region 204 is configured to substantially prevent foam insulation from flowing into an area proximate to a component coupled to the water heater.

As shown in FIG. 2C, third surface 218 is angled toward central region 202. This allows more foam insulation to be injected into an annular region between a water heater tank and water heater jacket and further allows the foam insulation to extend farther toward a center of the aperture 114 in the water heater jacket 112, which may reduce energy costs during the operation of the water heater. It is contemplated that a surface of the perimeter region 204 that is angled toward the central region 202 may include an angle in the range of about 0 degrees to 45 degrees. It is also contemplated that an angle greater than 45 degrees may be used.

More specifically, referring to the detail shown in FIG. 2F, a portion 218A of the third surface 218 that will extend from the central region 202 toward the outer surface of the water heater tank 100 is optionally oriented at an angle θ in the range of about 0 degrees to about 45 degrees with respect to the surface of the central region 202. Preferably, angle θ of surface portion 218A is in the range of about 2 degrees to about 30 degrees. It is also contemplated however, that an angle greater than 45 degrees may be used. Similarly, a portion 218B of the third surface 218 that will extend from the central region 202 toward the inner surface of the water heater jacket 112 is optionally oriented at an angle β in the range of about 0 degrees to about 45 degrees with respect to the central region 202. Preferably, angle β of surface portion 218B is in the range of about 2 degrees to about 30 degrees. It is also contemplated however, that an angle greater than 45 degrees may be used. Angles θ and β are optionally the same but may differ from one another.

As is best illustrated in FIG. 2F, the orientation of portions 218A and 218B of third surface 218 allows more foam insulation to be injected into an annular region between a water heater tank and water heater jacket. The angled orientation also allows the foam insulation to extend farther toward a center of the aperture 114 in the water heater jacket 112, thereby reducing the area of the annular region between the tank and jacket that is not filled with insulating foam. These features therefore help reduce energy costs during the operation of the water heater.

Figure 2E:
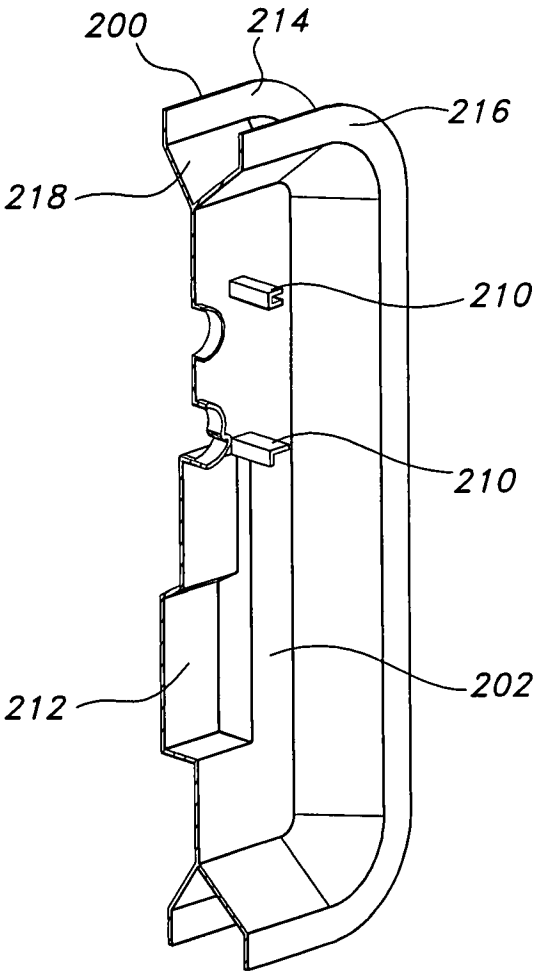
FIGS. 2D and 2E are cut-away, perspective views of the foam dam shown in FIG. 2A.
Figure 2D:
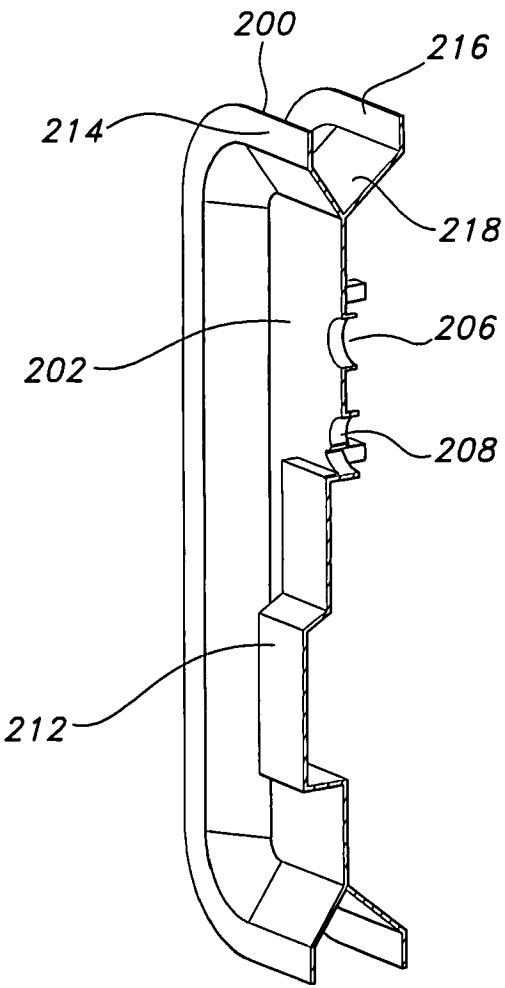

FIGS. 2D and 2E are perspective views of foam dam 200 according to one embodiment of the invention. FIG. 2D is a cut-away, perspective view, illustrating a portion of the front of the exemplary foam dam 200 that will face outwardly from the water heater tank 100 when assembled. Specifically, FIG. 2D shows central region 202 of foam dam 200 which includes manual reset aperture 206, temperature adjuster aperture 208 and heating element cover 212. Perimeter region 204 includes 204 includes first surface 214, second surface 216 and third surface 218, as described above.

FIG. 2E is a cut-away, perspective view of foam dam 200, illustrating a portion of the rear of the exemplary foam dam that will face the outer surface of the water heater tank 100 upon assembly. FIG. 2E shows central region 202 of foam dam 200 which includes heating element cover 212 and locating guides 210 coupled to central region 202 to assist coupling the foam dam to the water heater. Again, perimeter region 204 includes first surface 214, second surface 216 and third surface 218, as described above.

Figure 3:
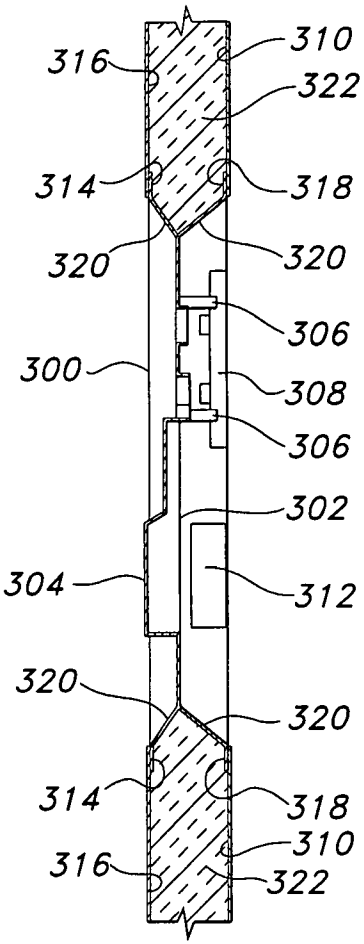
FIG. 3 is a cross sectional side view of an exemplary foam dam positioned between an inner surface of a water heater jacket and an outer surface of a water heater tank according to one embodiment of the invention.

FIG. 3 is a cross sectional side view of an exemplary foam dam, generally designated by the numeral "300", coupled to an inner surface 316 of a jacket and an outer surface 310 of a tank according to one embodiment of the invention. As shown in FIG. 3, a central region 302 of foam dam 300 includes locating guides 306 coupled to a central region 302 of the foam dam 300 to assist coupling the foam dam 300 to the water heater or a component thereof. As described above, it may be desirable to use locating guides to couple the foam dam to a thermostat or another component which may be coupled to the water heater. FIG. 3 shows locating guides 306 coupled to a thermostat 308. Thermostat 308 is coupled to water heater tank outer surface 310. As described above, an exemplary foam dam may not be coupled to a thermostat or another component. It is contemplated that a foam dam may be coupled directly to an outer surface of the water heater tank.

Central region 302 of foam dam 300 also includes heating element cover 304. Heating element cover 304 is configured to cover heating element 312 coupled to water heater tank outer surface 310. As described above, it may be desirable for a heating element cover to be integral to the foam dam to reduce costs during the manufacturing and/or assembly process. It is also contemplated however, that a heating element cover may be coupled to the foam dam during the manufacturing process or that a heating element cover may not be used. The precise location of heating element 312, heating element cover 304, thermostat 308 and locating guides 306 shown in FIG. 3 is merely illustrative and is not limiting.

Foam dam 300 includes perimeter region first surface 314 positioned adjacent water heater jacket inner surface 316, perimeter region second surface 318 positioned adjacent water heater tank outer surface 310, and perimeter region third surface 320 extending from perimeter region first surface 314 to perimeter region second surface 318. Perimeter region third surface 320 is configured to substantially prevent foam insulation (depicted by the numeral "322") from flowing into an area proximate to thermostat 308 and heating element 312. It is contemplated that an exemplary foam dam may substantially or completely prevent foam insulation from flowing into an area proximate to other components that may be coupled to the water heater.

Like third surface 218 of foam dam 200, perimeter region third surface 320 of foam dam 300 is angled toward central region 302, allowing for a greater amount of foam insulation 322 to be injected into an annular region between water heater tank outer surface 310 and water heater jacket inner surface 316. As described above, configuring the foam dam to allow a greater amount of foam insulation to be injected into the annular region may reduce energy costs during the operation of the water heater.

It may be desirable for an exemplary foam dam to be formed of materials which are thermally insulating. An exemplary thermally insulating foam dam may help to thermally insulate heat from the water heater tank along with the foam insulation to reduce energy costs during the operation of the water heater. It may also be desirable for at least a portion of the material that forms the foam dam to have sufficient flexibility such that it contours to an inner surface of the water heater jacket and an outer surface of the water heater tank. Such flexibility is advantageous to assist in substantially preventing foam insulation from flowing into an area proximate to components coupled to the water heater. Exemplary foam dams may be formed of the material which is at least one of plastic, thermoset or rubber.

It may also be desirable to form the portions of the perimeter region which contact the inner surface of the water heater jacket and the outer surface of the water heater tank from flexible material while forming the central region, optionally integral with the perimeter region, from material that is rigid. This may help the foam dam to contour to the tank and jacket, while simultaneously providing a stable, secure foam dam and component cover.

It is also contemplated that the perimeter region of an exemplary foam dam may be formed with material that is rigid. A flexible material, such as low density foam for example, may be coupled to or positioned adjacent the portions of the perimeter region which contact the inner surface of the water heater jacket and the outer surface of the water heater tank. Such flexible material or seals are advantageous to help the foam dam to contour to the inner surface of the water heater jacket and the outer surface of the water heater tank. It may be desirable for the flexible material or seals to be integral to the foam dam. It is also contemplated that the flexible material or seal or seals may be separate components from the foam dam and added to the foam dam after the foam dam is constructed and at the time of water heater assembly.

It is contemplated that a non-conductive coating may be placed on at least the portion of the perimeter region which contacts the outer surface of the water heater tank to thermally insulate heat from the water heater tank along with the foam insulation to reduce energy costs during the operation of the water heater. A flexible material, which may include low density foam, may also be used with the non-conductive coating. The flexible material or seal may be placed between the non-conductive and the outer surface of the water heater tank to help the foam dam to contour to the inner surface of the water heater jacket and the outer surface of the water heater tank.

Figure 4:
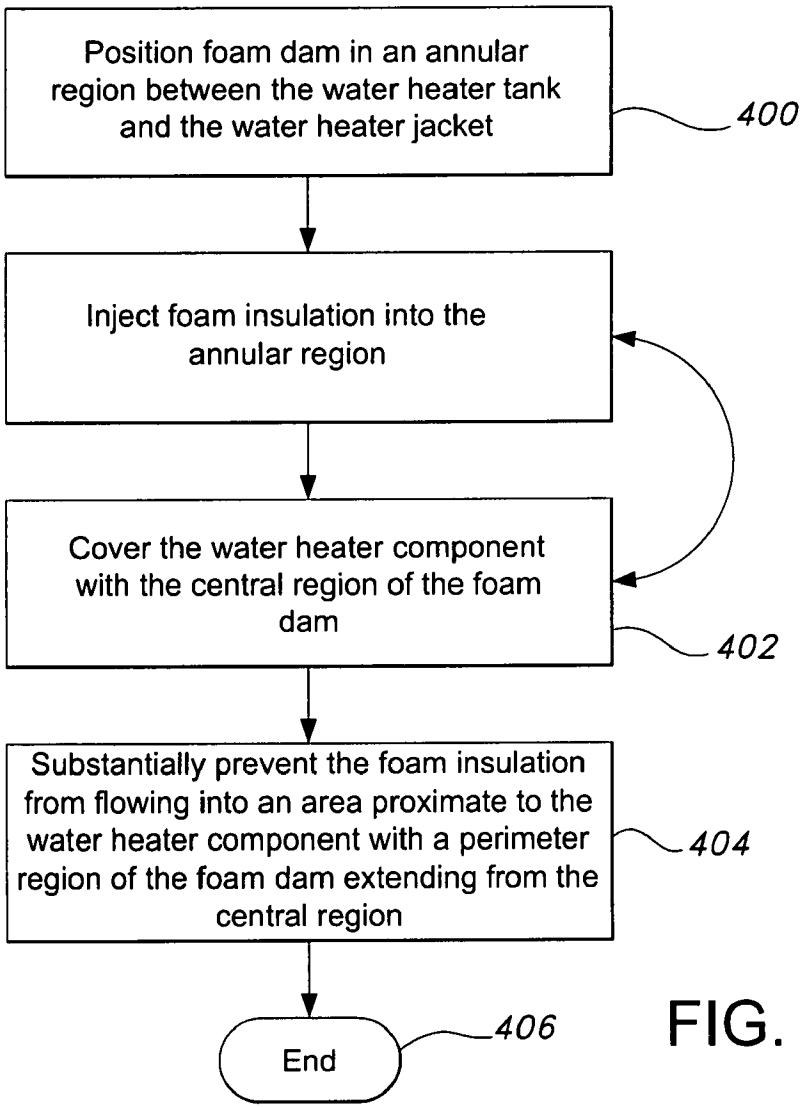
FIG. 4 is a flowchart illustrating an exemplary method for covering a component, such as an electrical component, of a water heater and for substantially preventing foam insulation from flowing into an area proximate to the component.

FIG. 4 is a flowchart illustrating an exemplary method for covering an electrical component of a water heater and for substantially preventing foam insulation from flowing into an area proximate to the electrical component. At step 400, a foam dam is positioned in an annular region between the water heater tank and the water heater jacket. As described above, a foam dam may include at least one locating guide to position and couple the foam dam to a thermostat or another component which may be coupled to the water heater. It is contemplated that the foam dam will be positioned before the water heater jacket is placed over the water heater jacket.

It is contemplated that the distance between the surface of the perimeter region of the foam dam which contacts the outer surface of the tank and the surface of the perimeter region of the foam dam which contacts the inner surface of the jacket is greater than the width of the annular region. This may help to create more force acting on the foam dam and the jacket and tank. The force creates a seal between the surface of the perimeter region of the foam dam which contacts the outer surface of the tank and the surface of the perimeter region of the foam dam which contacts the inner surface of the jacket. An increase in force helps to prevent the foam dam from moving and helps to substantially prevent foam insulation from flowing into an area proximate to components coupled to the water heater.

At step 402, foam insulation is injected into the annular region between the water heater tank and the water heater jacket. At step 402, the central region of the foam dam is used to cover a water heater component. As described above, the central region may used to cover various components, including a thermostat, electrical components and a heating element. It is contemplated that central region may be used to limit user access to any component which may cause harm from human contact. The central region may also include at least one aperture for allowing the user access to at least one control component coupled to the tank.

At step 404, a perimeter region of the foam dam is used to substantially prevent foam insulation from flowing into an area proximate to components coupled to the water heater. As described above, the perimeter region may include a flexible material or seal to contour to the inner surface of the water heater jacket and the outer surface of the water heater tank and assist with this process. A flexible material may also be coupled to the portions of the perimeter region which contact the inner surface of the water heater jacket and the outer surface of the water heater tank to assist with this process. The perimeter region may also be angled toward central region, allowing for a greater amount of foam insulation to be injected into the annular region between water heater tank and water heater jacket, reducing energy costs during the operation of the water heater. The method ends at step 406.

Although the invention is illustrated and described herein with reference to specific embodiments, the invention is not intended to be limited to the details shown. Rather, various modifications may be made in the details within the scope and range of equivalents of the claims and without departing from the invention.

What is claimed is:

1. A foam dam for use with a water heater having a tank and a jacket together defining an annular region, the foam dam comprising;

a perimeter region defining a surface to at least substantially traverse the annular region, wherein the perimeter region is configured to substantially prevent foam insulation from flowing into an area proximate to a component coupled to the tank; and a central region having a surface angled with respect to the surface of the perimeter region, the surface of the central region being configured to cover the component and positioned to extend inwardly from an inside edge of the perimeter region, an outer edge of the surface of the central region being integral to, and contiguous with, the inside edge of the perimeter region.

2. A foam dam according to claim 1, wherein the central region has a surface configured to cover an electrical component.

3. A foam dam according to claim 1, wherein the material that forms the foam dam is thermally insulating.

4. A foam dam according to claim 1, wherein the material that forms the foam dam is at least one of plastic, thermoset or rubber.

5. A foam dam according to claim 1, wherein at least a portion of the material that forms the foam dam has flexibility that contours to an inner surface of the water heater jacket and an outer surface of the water heater tank to assist in substantially preventing foam insulation from flowing into the area proximate to the component.

6. A foam dam according to claim 1, further including a non-conductive coating on the perimeter region.

7. A foam dam according to claim 1, wherein the central region includes at east one locating guide to assist coupling the foam dam to the water heater.

8. A foam dam according to claim 1, wherein the central region includes at least one aperture for accessing at least one control component coupled to the tank.

9. A foam dam according to claim 1, wherein the central region further includes a heating element cover.

10. A foam dam for use with a water heater having a tank and a jacket together defining an annular region, the foam dam comprising;

means for covering a component on the tank of the water heater; and means, integral with the component covering means, for substantially preventing foam insulation from flowing from the annular region into an area proximate to the component.

11. A foam dam according to claim 10, wherein the means for covering a component of the water heater includes means for covering at least one electrical component.

12. A foam dam for use with a water heater having a tank and a jacket together defining an annular region, the foam dam comprising;

a central region; and a perimeter region extending from the central region, the perimeter region including a first surface occupying a first plane, a second surface occupying a second plane spaced from the first plane and a third surface extending from the first surface to the second surface, wherein the third surface includes a first portion extending from the central region to the first surface at a first angle greater than 0 degrees with respect to the central region and a second portion extending from the central region to the second surface at a second angle greater than 0 degrees with respect to the central region, and wherein the third surface substantially prevents foam insulation from flowing into an area proximate to an electrical component.

13. A foam dam according to claim 12, wherein the first and second angles are greater than 0 degrees to about 45 degrees.

14. A foam dam according to claim 12, wherein the first and second angles are in the range of about 2 degrees to about 30 degrees.

15. A foam dam according to claim 12, wherein the first and second angles are different from each other.

16. A foam dam according to claim 12, wherein the first and second angles are the same as each other.

17. A water heater comprising;

a tank;

a jacket surrounding the tank;

foam insulation in an annular region between the tank and jacket;

a component coupled to the tank; and a foam dam including a central region having a surface covering the component and a perimeter region extending from the central region, the perimeter region of the foam dam having an outermost surface contacting an inner surface of the jacket and an innermost surface contacting an outer surface of the tank, the perimeter region defining a surface at least substantially traversing the annular region, wherein the perimeter region forms a barrier between the foam insulation and an area proximate to the component.

18. A water heater according to claim 17, said component being an electrical component.

19. A water heater according to claim 18, said electrical component being a thermostat.

20. A method for covering a component of a water heater and for substantially preventing foam insulation from flowing into an area proximate to the component, the method comprising;

positioning a foam dam in an annular region between a water heater tank and a water heater jacket such that an outermost surface of the foam dam contacts an inner surface of the jacket and an innermost surface of the foam dam contacts an outer surface of the tank;

covering the component with a central region of the foam dam;

injecting foam insulation into the annular region; and substantially preventing the foam insulation from flowing into an area proximate to the component with a perimeter region of the foam dam.

21. A method according to claim 20, wherein the method further includes positioning a seal adjacent the perimeter region of the foam dam to conform to an inner surface of the water heater jacket or an outer surface of the water heater tank.

22. A method according to claim 21, wherein the method further includes positioning one or more seals adjacent the perimeter region of the foam dam to conform to an inner surface of the water heater jacket and an outer surface of the water heater tank.

23. A method according to claim 20, wherein the method further includes positioning a non-conductive coating on the perimeter region of the foam dam adjacent an outer surface of the water heater tank.

* * * * *

UNITED STATES PATENT AND TRADEMARK OFFICE

CERTIFICATE OF CORRECTION

PATENT NO. : 7,409,925 B2
APPLICATION NO. : 11/484452
DATED : August 12, 2008
INVENTOR(S) : Lannes et al.

It is certified that error appears in the above-identified patent and that said Letters Patent is hereby corrected as shown below:

At Column 8, Claim 7, line 40, “east” should read --least--

Signed and Sealed this

Twentieth Day of January, 2009

JON W. DUDAS
*Director of the United States Patent and Trademark Office*